US006922123B2

(12) United States Patent
Lalonde et al.

(10) Patent No.: US 6,922,123 B2
(45) Date of Patent: Jul. 26, 2005

(54) MAGNETIC DETENT ACTION FOR SWITCHES

(75) Inventors: Ronald H. Lalonde, Kokomo, IN (US); David J. Hudson, Kokomo, IN (US); David C Becker, Kokomo, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/299,924

(22) Filed: Nov. 19, 2002

(65) Prior Publication Data

US 2004/0094393 A1 May 20, 2004

(51) Int. Cl.[7] ..... H01H 9/00
(52) U.S. Cl. ..... 335/207; 200/404
(58) Field of Search ..... 335/205–207; 200/404, 84 R

(56) References Cited

U.S. PATENT DOCUMENTS 3,114,809 A * 12/1963 Benson ..... 335/207
3,209,097 A * 9/1965 Shlesinger, Jr. ..... 335/207
4,027,278 A * 5/1977 Giannini ..... 335/154
4,054,944 A * 10/1977 Lau ..... 335/207
4,068,202 A * 1/1978 Lyons, III ..... 335/207
5,180,050 A 1/1993 Rada et al.
5,537,893 A 7/1996 Snider
5,623,854 A 4/1997 Snider

* cited by examiner

*Primary Examiner*—Lincoln Donovan
(74) *Attorney, Agent, or Firm*—Stefan V. Chmielewski

(57) ABSTRACT

The present invention involves a magnetic detent action device for switches utilizes the magnetic field interaction of a pair of magnetic members each having a side-by-side multipole magnetic pattern. One magnetic member is fixed relative to a switch body, while the other magnetic member is attached to a switch actuator. The magnetic members have a repeating pattern of north, south, and nonmagnetic portions. The switch body holds the two magnetic members in contact or in closely parallel proximity, and, as the switch actuator is moved, the two magnetic members and their respective magnetic poles move relative to each other creating a switch detent action as the magnetic fields of alike and opposite poles of the two magnetic members pass through each other. The magnetic detent action may be implemented in slide, rotary, or other switches.

31 Claims, 6 Drawing Sheets

33
35
41
42
30
31
36
37
38
53
51
50a
52
55
56
57
58
63
62
61
50b

MAGNETIC DETENT ACTION FOR SWITCHES

TECHNICAL BACKGROUND

This invention relates to detent action devices for multiposition switches.

BACKGROUND OF THE INVENTION

A desirable feature of switches, especially variable adjustment or multiposition rotary and slide switches, is a plurality of different switch positions in which the switch actuator and switching mechanism will be positively held. Additionally, it is desirable for the switch to provide tactile feedback as the switch actuator transits the plurality of different positions.

Switch detent devices for providing tactile feedback and positive holding in selected detent positions generally include spring metal or spring-loaded balls or rollers that snap into apertures or recesses defined in the switch mechanism.

The above-mentioned detent action switches are subject to poor performance and failure as they rely on multiple parts that mechanically engage and disengage and which may break or wear or seize up. Prior known detent switches do not provide such a solution.

SUMMARY OF THE INVENTION

The present invention is directed to a switch detent action device that provides tactile feedback and positioning for a plurality of switch actuator positions using magnetic components.

The inventive detent device includes a first and second member having a first and second magnetic face, respectively. Each magnetic face includes at least one side-by-side pair of N and S magnetic poles creating a magnetic field extending adjacent each face. The first member is fixed relative to the body of the switch and the second member is engaged to a switch actuator. The first and second magnetic faces of the members are positioned parallel to and facing each other such that the magnetic fields are in communication and the faces move relative to each other as the switch actuator is moved. Thus, as the magnetic faces move relative to each other, alternatively, like poles align repelling the two members, and opposite poles align attracting the two members. The alternating attracting and repelling of the two members provides the tactile feedback and positive holding detent action for the switch.

According to a first exemplary embodiment of the invention, a detent device for a slide switch includes magnetic sheets having adjacently located magnetized faces. In a second exemplary embodiment, a detent device for a rotary switch includes magnetic sheets comprising at least a portion of a disk, the sheets having adjacently located magnetized faces. The magnetized faces of both embodiments include a repeating pattern of poles, for example, an N pole, an S pole, and a nonmagnetized space dividing each pair of N and S poles.

BRIEF DESCRIPTION OF THE DRAWINGS

The present invention will now be described, by way of example, with reference to the accompanying drawings, in which.

Figure 1:
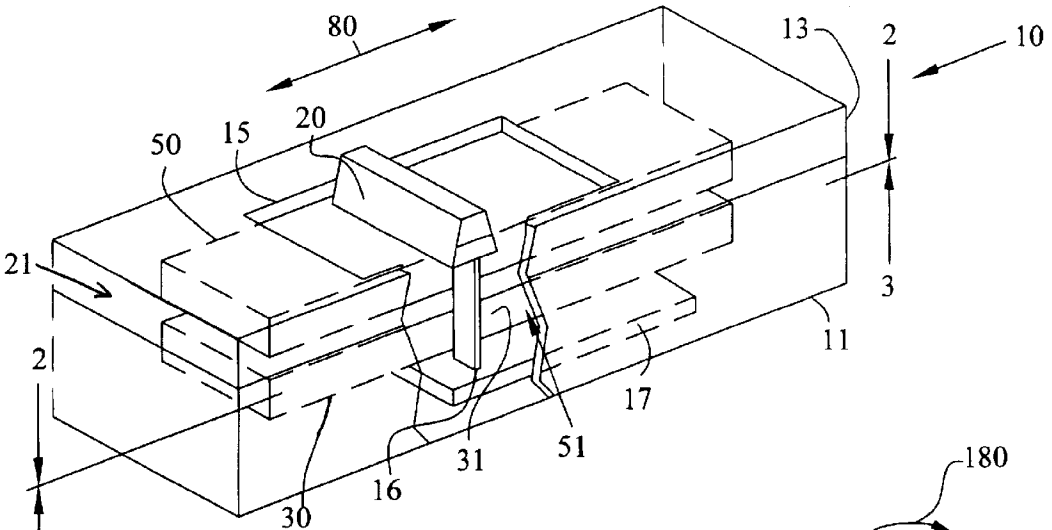
FIG. 1 is a perspective view of a first exemplary embodiment of the detent device according to the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate two embodiments of the invention and such exemplification is not to be construed as limiting the scope of the invention in any manner.

DESCRIPTION OF INVENTION

The embodiments disclosed below are not intended to be exhaustive or limit the invention to the precise forms disclosed in the following detailed description. Rather, the embodiments are chosen and described so that others skilled in the art may utilize their teachings.

FIG. 1 shows a first exemplary embodiment of detent device 21 associated with switch assembly 10. Switch assembly 10 includes switch body 11, switch bezel or face plate 13, and switch actuator 16, which actuates switch mechanism 17. Switch bezel 13 defines opening 15 for switch control 20 and switch actuator 16. Switch mechanism 17 includes two or more positions that are selected by moving switch actuator 16 and that provide mechanical, electrical, pneumatic, or other switching of a device (not shown) that is connected to switch mechanism 17.

Detent device 21 includes first magnetic member 30 and second magnetic member 50. First member 30 is attached to switch body 11 or another component of switch assembly 10 such that first member 30 is in a fixed position relative to switch body 11. Second member 50 includes second face 51 located adjacent to and in contact with or closely parallel to first magnetic face 31 of first member 30. Second member 50 is attached to switch actuator 16 or switch control 20 and is supported by switch assembly 10 such that movement of switch control 20 and switch actuator 16 moves second face 51 along axis of motion 80 relative to first face 31.

Figures 2, 3A, 3B:
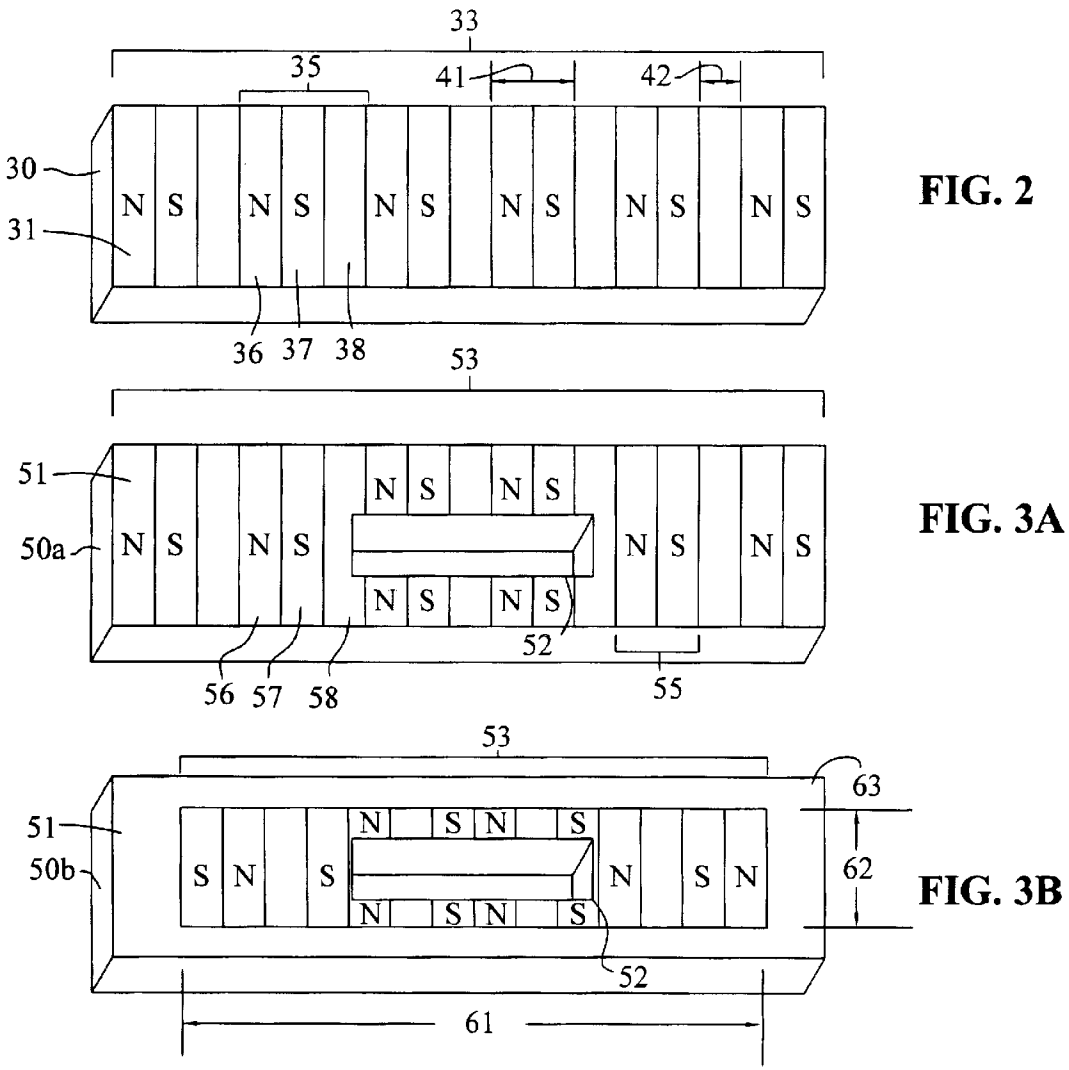
FIG. 2 is a cross-sectional view of the detent device shown in FIG. 1 taken long lines 2—2 and showing the multipole magnetic pattern of the second member.
FIG. 3A is a cross-sectional view of the detent device shown in FIG. 1 taken along lines 3—3 and showing the multipole magnetic pattern of the first member.
FIG. 3B is a cross-sectional view of the detent device shown in FIG. 1 taken along lines 3—3 and showing a second multipole magnetic pattern of the first member.

Referring to FIG. 2, first member 30 may be a rectangular sheet having first magnetic face 31 that is permanently magnetized with multipole magnetization pattern 33. Magnetization pattern 33 includes at least one N and S magnetized pole pair 35. In the first exemplary embodiment of detent device 21, first member 30 includes a plurality of magnetized pole pairs 35 and is stamped to shape from a synthetic resin sheet having embedded magnetic particles that are magnetized in accordance with magnetization pattern 33 during the manufacturing process. Such magnetic sheets are commonly used for many applications, for example, for refrigerator magnets. However, other materials having magnetic properties may also be used. For example, first member 30 may be constructed of a single magnetic material, or may be constructed of one or more nonmagnetic materials laminated with a magnetic material. Additionally, first member 30 may also be constructed from other magnetic materials, such as ceramic magnetic material.

Each magnetic pole pair 35 includes N pole area 36 and S pole area 37 located side by side on first face 31. Each magnetic pole pair 35 may be limited to a surface region near first face 31, or may penetrate vertically through first member 30. Multipole magnetization pattern 33 may also include a nonmagnetized space 38 located between each adjacent N and S pole pair 35.

Pair span 41 and space span 42 are selected to determine the strength of the detent action, the number of detent positions, and the amount of switch control 20 travel between detent positions. For example, as pair span 41 is increased, the strength of the detent action also increases, and as space span 42 increases, the travel distance between detent positions increases.

Referring to FIG. 3A, second member 50A may be similar in design construction to first member 30. Second member 50A may also define opening 52 which provides clearance for switch actuator 16 so that actuator 16 may extend between first member 30 and switch mechanism 17. Second member 50A includes multipole magnetization pattern 53 having at least one N and S pole pair 55 on second face 51. Pole pair 55 includes side by side N pole 56 and S pole 57. The exemplary embodiment includes a plurality of pole pairs 55 having a nonmagnetized space 58 between adjacent pole pairs 55. Multipole magnetization pattern 53 may also have a pole sequence identical to multipole magnetization pattern 33, or may utilize a different pattern as oriented relative to pattern 33, for example, as shown in FIG. 3B, an S pole, an N pole, and a nonmagnetized space.

Multipole magnetization pattern 53 may span the entire second face 51 of second member 50A, or, as shown in FIG. 3B, may span only a portion of length 61 and width 62 of second face 51, leaving nonmagnetized area 63 around one or more sides of magnetization pattern 53. Pattern length 61 and pattern width 62 of magnet pattern 53, as well as the strength of each pole pair 55 and the size of nonmagnetized space 58 between adjacent pole pairs 55, will determine the strength of magnetic fields 70 generated for providing a detent feel and position holding force 75 to switch actuator 20. Similar features may also be incorporated into multipole magnetization pattern 33 of first member 30.

Figure 4A:
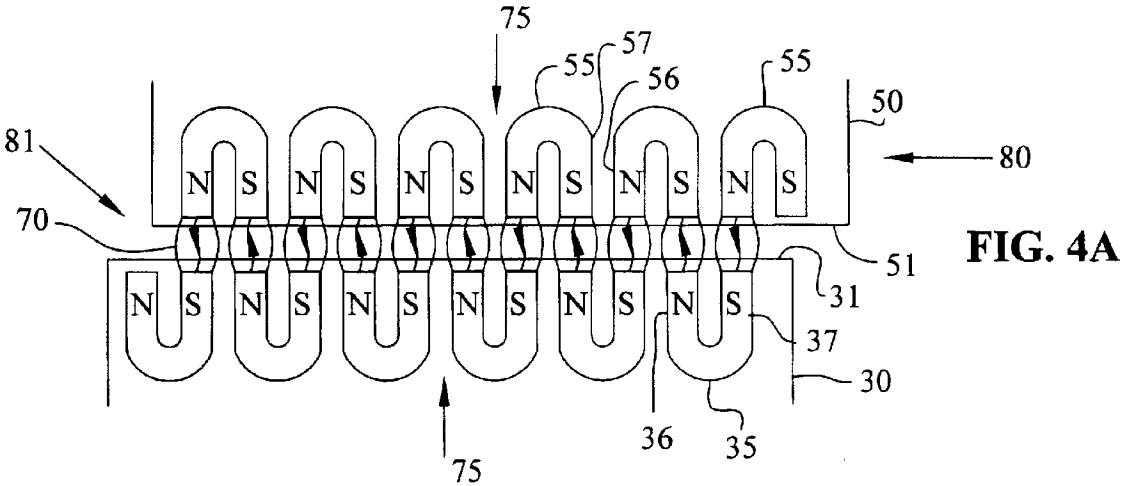
FIG. 4A is an alternative depiction of the magnetic field interaction between the first and second members of the detent device of FIG. 1, shown in a first position.

Referring again to FIG. 1, first member 30 and second member 50 are arranged so that first face 31 and second face 51 are facing each other and are closely parallel so that magnetic fields 70, shown in FIG. 4A, generated by pole pairs 35 and 55 are in communication, that is, the flux lines of magnet fields 70 interact between pole pairs 35 and 55 creating magnetic attraction and repulsion. First face 31 and second face 51 may be separated by open space or a material that is permeable by magnet field 70, such as plastic. Alternatively, first face 31 and second face 51 may be in sliding contact.

When first member 30 and second member 50 are positioned so that oppositely polarized poles are aligned enough to be in communication, the resulting magnetic attraction will cause second member 50 to resist movement relative to first member 30. Correspondingly, similarly aligned poles resulting in magnetic repulsion will encourage movement of second member 50 relative to first member 30. Although the resulting magnetic forces do not lock second member 50 in position and do not necessarily propel it into motion, the magnetic forces provide a tactile feel of detented positions as second member 50 is manually moved such that it overcomes the magnetic forces created as various positions are transited.

The interaction of magnetic fields 70 generated by pole pairs 35 and 55, as members 30 and 50 are moved along axis of motion 80 relative to each other, is illustrated by depictions shown in FIGS. 4A through 4D. FIG. 4A is an illustrative depiction of an elevation view of adjacent first face 31 and second face 51. First member 30 and second member 50 are shown in first position 81 in which magnetic pole pairs 35 and 55 of respective faces 31 and 51 are aligned such that N pole magnetized portions 36 and 56 of one facing surface are located opposite or nearly opposite S pole magnetized areas 37 and 57 of the opposite facing surface. Therefore, as depicted by magnetic field 70, attracting magnetic flux lines flow from each N pole 36 of first face 31 to each S pole 57 of second face 51 and from each N pole 56 of second face 51 to each S pole 37 of first face 31, resulting in an attracting holding force 75 between first member 30 and second member 50. Holding force 75 resists motion of second member 50 along axis of motion 80. Therefore, when switch actuator 20 is moved along axis of motion 80, a detent action-like tactile feel is transmitted by magnetic fields 70 through second member 50 to switch actuator 20.

Figure 4B:
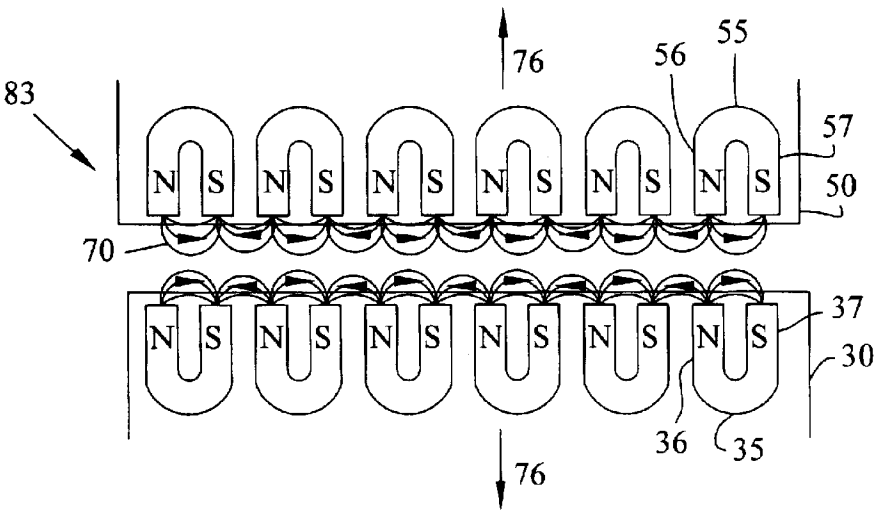
FIG. 4B is an illustrative elevation depiction of the magnetic field interaction between the first and second members of the detent device of FIG. 1, shown in a second position.

Referring now to FIG. 4B, as switch control 20 is moved along axis of motion 80 with sufficient force to overcome holding force 75, pole pairs 35 and 55 of first face 31 and second face 51 move relative to each other such that N poles 36 of first face 31 now become located opposite N poles 56 of second face 51, and likewise opposite-facing S poles 37 of first face 31 become located opposite S poles 57 of second face 51. The resulting magnetic flux lines of magnetic field 70 no longer provide an attracting holding force 75 between first member 30 and second member 50, rather magnetic field 70 provides repelling force 76, which causes second member 50 to resist remaining in second position 83 relative to first member 30 and encourage movement away from second position 83. Therefore, unless friction from the components of switch 10 apply a sufficient holding force oil second member 50 to overcome repelling force 76, second member 50, as shown in FIG. 4C, will continue along axis of motion 80 until located in third position 85 relative to first member 30, or second member 50, as shown in FIG. 4A, will return to first position 81, even if switch control 20 was released from movement in second position 83.

Figure 4C:
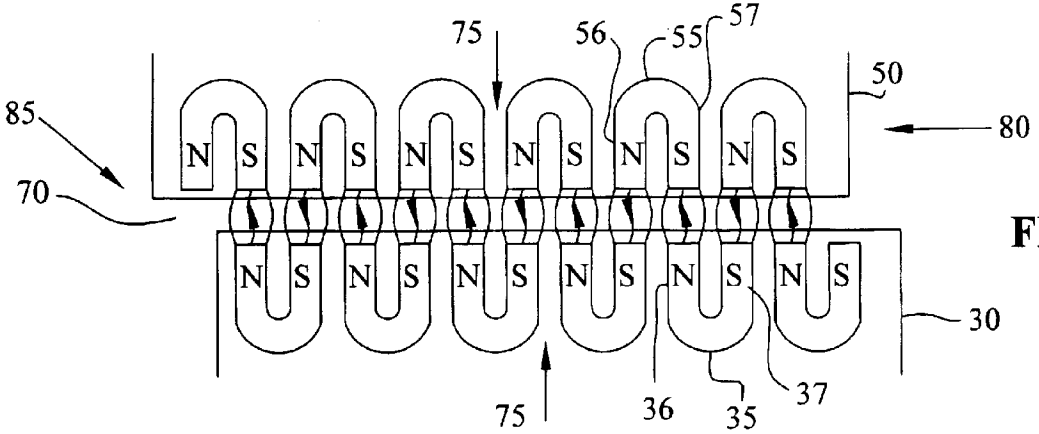
FIG. 4C is an illustrative elevation depiction of the magnetic field interaction between the first and second members of the detent device of FIG. 1, shown in a third position.
Figure 4D:
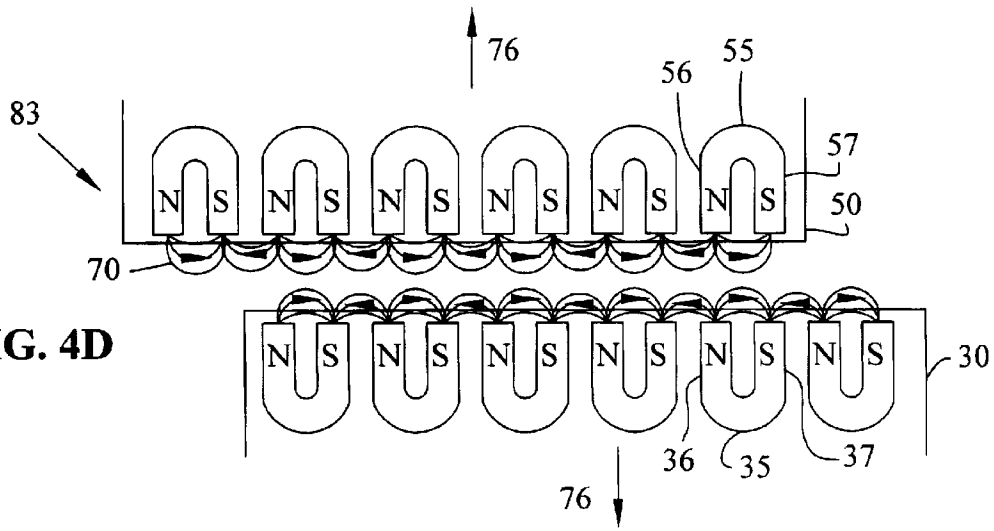
FIG. 4D is an illustrative elevation depiction of the magnetic field interaction of the first and second members of the detent device of FIG. 1, shown in a fourth position.

Third position 85, as shown in FIG. 4C, aligns opposite N and S poles 36 and 57, and 56 and 37. Thus, attracting holding force 75 is applied between first member 30 and second member 50 in third position 85, as was provided in first position 81. If switch actuator 20 is moved further in the same direction of axis of motion 80, as shown in FIG. 4D, second member 50 located in fourth position 87 relative to first member 30, will again provide magnetic fields 70 causing repelling force 76 that resists switch 10 remaining in fourth position 87.

In this manner, magnetic field 70 communication between multipole magnetization patterns 33 and 53 create a plurality of detent positions which provide the tactile feel of various switch positions, a holding force that resists movement from any switch position in which opposite poles are aligned, and a repelling force that resists positioning in any switch position in which alike poles are aligned.

Referring again to FIG. 2, features of magnetization patterns 33 and 53, including the pole pair span 41 of N and S pole pairs 35 and 55, and nonmagnetized space span 42 of nonmagnetized spaces 38 and 58 determines the distance between each detented switch position. Additionally, the number of pole pairs 35 and 55 located on faces 31 and 51 and the mechanical limits of travel of member 50 in switch body 11 determine the total number of switch positions for detent device 21.

Figure 5:
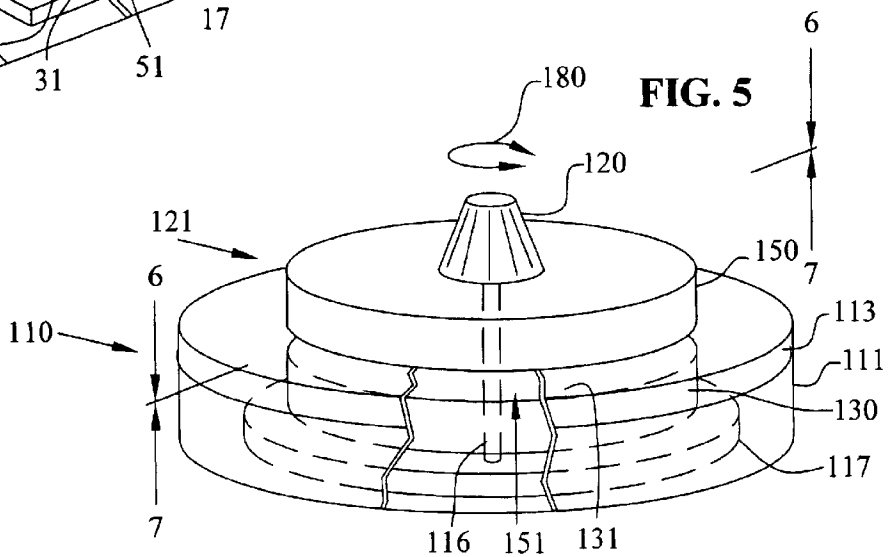
FIG. 5 is a perspective view of a second exemplary embodiment of the detent device according to the present invention.

Referring to FIG. 5, a second exemplary embodiment includes rotary detent device 121 for providing detent action for rotary switch 110. Rotary switch 110 may be a potentiometer, multi-position rotary switch, or other rotary action type switch. Rotary switch 110 generally includes switch body 111, switch bezel or face plate 113, and switch actuator 116 which actuates potentiometer or switch contact mechanism 117.

Similar to detent device 21 shown in FIG. 1, detent device 121 includes first disk-shaped member 30 fixed relative to switch body 111 and second disk-shaped member 150 attached to switch actuator 120. Each magnetic member 130 and 150 comprises at least a portion of a circle or disk. Rotary movement of switch actuator 120 rotates second member 150 along axis of motion 180 relative to first member 130. In the embodiment shown in FIG. 5, first member 130 is enclosed by switch body 111 and switch bezel 113. First member 130 and second member 150 may be separated by switch bezel 113, which is constructed of a material that is permeable by magnetic field 70, such as plastic. Second member 150 is fastened to switch control 120 and switch actuator 116.

Figure 7:
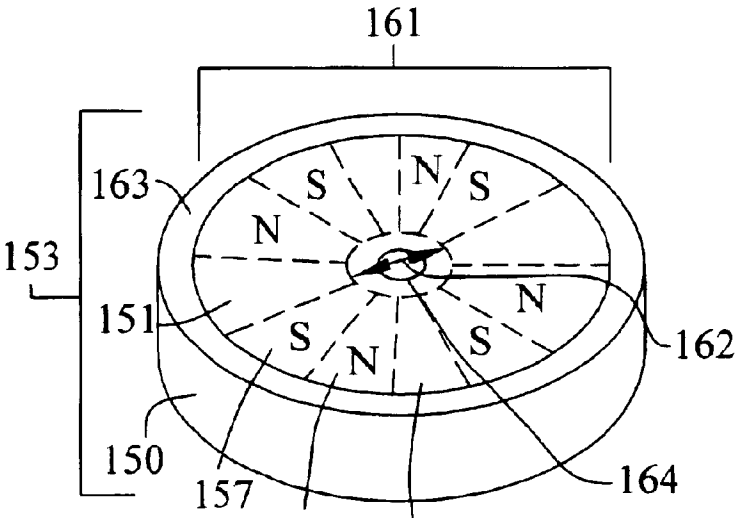
FIG. 7 is a cross-sectional view of the detent device of FIG. 5, taken along lines 7—7 and showing the multipole magnetic pattern of the first member.
Figure 6:
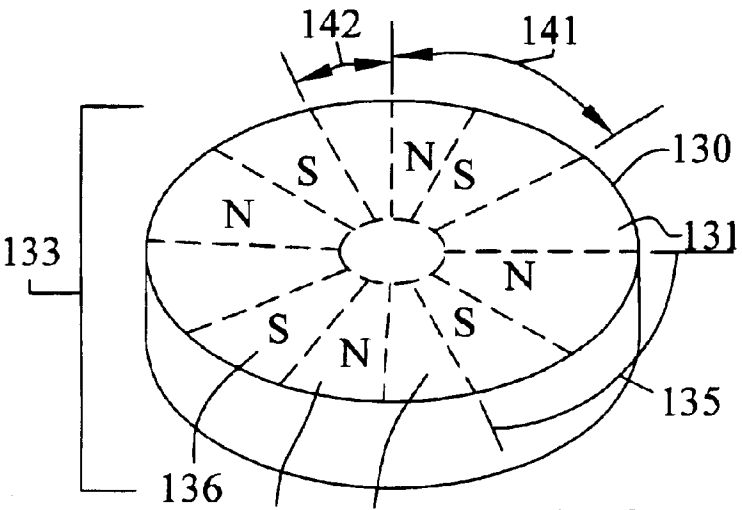
FIG. 6 is a cross-sectional view of the detent device of FIG. 5 taken along lines 6—6 and showing the multipole magnetic pattern of the second member.

Referring to FIGS. 6 and 7, first surface 131 of first member 130 and second surface 151 of second member 150 include multipole magnetization patterns 133 and 153, respectively, which provide magnetic field interaction between adjacent first face 131 and second face 151.

Referring to FIG. 6, first member 130 may be constructed of a permanently magnetized material or laminated materials as discussed above for the first exemplary embodiment. However, rather than having a linear magnetic pattern, first member 130 has angular magnetic pattern 133 that spans a diameter or an arc of first member 130. Magnetic pattern 133 includes a plurality of N and S pole pairs 135. Each pole pair 135 includes an N pole 136 and an S pole 137 located side-by-side. Additionally, adjacent pole pairs 135 may be separated by nonmagnetized space 138. The number of rotational positions provided by detent device 121 is determined in part by the angular span of pole pair span 141 of each pole pair 135 and the angular span of space span 142 of each nonmagnetized space 138.

Referring to FIG. 7, the sequence of poles 156 and 157 may be reversed for second member 150 (FIG. 7), or may be the same as for first member 130 (e.g., FIG. 6). Additionally, magnetic pattern 153 may extend between inside diameter 162 and outer diameter 161, thus providing nonmagnetized areas 163 on second surface 151. Second member 150 defines bore 164 so that switch actuator 116 may extend through and rotate relative to second member 150.

The shape of magnetic fields 70 and the magnetic field interaction between first member 130 and second member 150 is similar to that explained above for the first exemplary embodiment, except that axis of motion 180 is rotary rather than linear, and magnetic fields 70 are formed according to the angular shape and pattern.

Linear detent device 21 and rotary detent device 121 may be used for many types of switches, for example, mechanical actuating switches, electrical switches, and pneumatic switches, such as the mode, fan speed, and temperature switches used for HVAC controls in an automobile. In such an application, switch bezel 117 may comprise a control unit trim or face plate and include switch position markings.

Figure 8:
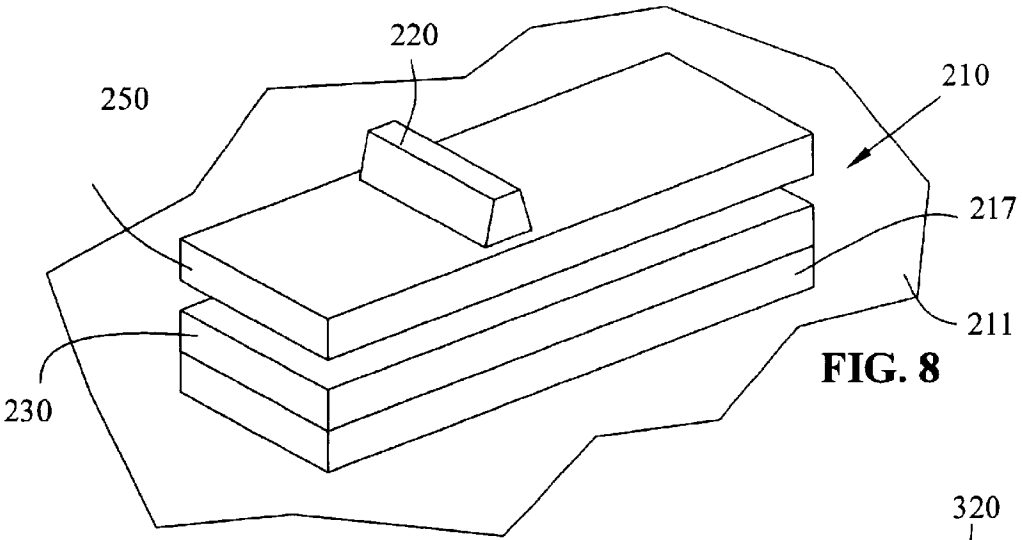
FIG. 8 is a perspective view of the detent device of FIG. 1 having the first member mounted on a printed circuit board.
Figure 9:
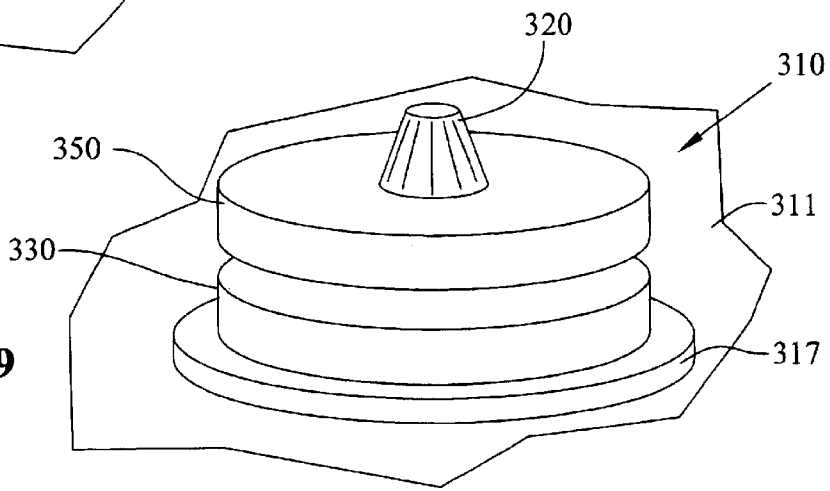
FIG. 9 is a perspective view of the detent device of FIG. 5 having the first member mounted on a printed circuit board.

Detent devices 21 and 121 may also be used to provide detent action for a variety of switch configurations, for example, referring to FIGS. 8 and 9, linear switch 210, having control 220 attached to second sheet 250, also includes first sheet 230 and switch contacts 217 mounted to or laminated on circuit board 211 or a component of circuit board 211. Likewise, rotary switch 310 having control 320 attached to second sheet 350 includes first sheet 330 and potentiometer 317 mounted on or laminated to circuit board 311 or a component of circuit board 311.

Additionally, a specific switch configuration can be implemented to perform different switch applications merely by providing different pairs of magnetic members 30 and 50 having different magnetization patterns 33 and 53. Also, one of magnetization patterns 33 and 53 may be a portion of member 30 or 50 capable of being attracted or repelled by a magnetic field, such as a metallic portion, while the other magnetization pattern 33 or 53 includes at least one pair of magnetic poles 35 or 55.

In summary, the various embodiments of the inventive magnetic detent device provide tactile feedback and positive position holding using simple, inexpensive, and highly reliable components. Specifically, spring, ball, and other preloaded devices for engagement with recesses providing detent action are not necessary to implement the detent action according to the current invention. Rather, detent action is provided by the use of reliable and easily configured magnetic members.

Although described in the exemplary embodiments, it will be understood that various modifications may be made to the subject matter without departing from the intended and proper scope of the invention. Accordingly, it will be understood that switches and other actuators incorporating an embodiment of the detent device may fall within the scope of this invention, which is defined by the appended claims.

What is claimed is:

1. A detent device for a switch having a switch mechanism, comprising:

a first member having a first face, said first member adapted to be disposed with the switch, said first face having at least one first pair of magnetic poles creating a first magnetic field extending adjacent said first face;

a second member having a second face, said second member adapted to be coupled to the switch mechanism and movably disposed with said first member, said second face having at least one second pair of magnetic poles creating a second magnetic field extending adjacent said second face; and a switch actuator coupled to said second member and extending beyond said first member, said switch actuator adapted to manipulate the switch mechanism located remotely from said first and second magnetic fields;

said first member associated with said second member such that said first face is positioned facing said second face and said first and second magnetic fields are in communication, and said at least one first pair and said at least one second pair of magnetic poles are structured and arranged to define at least three magnetic detent positions, each of said detent positions resisting movement of said second member relative to said first member, said magnetic fields of said first and second member providing a tactile detent feel and a position holding force.

2. The detent device of claim 1, said second member capable of moving at least one of laterally and rotationally relative to said first member as said switch actuator is moved.

3. The detent device of claim 1, wherein:

said second member includes at least a portion of a disk defining said second face, and said second pair of magnetic poles are arranged along a diameter of said second face.

4. The detent device of claim 3, wherein said magnetic poles extend in a band from a first to a second diameter around said face.

5. The detent device of claim 1, further comprising:

a rotary switch actuator coupled to said second member, said second member capable of rotational movement relative to said first member when said switch actuator is moved, and said second member including at least a portion of a disk defining said second face, said second pair of magnetic poles being arranged along a diameter of said second face.

6. The detent device of claim 1, further comprising a slide switch actuator coupled to said second member, said second member capable of lateral movement along a lateral axis of motion relative to said first member when said switch actuator is moved, said at least one second pair of magnetic poles arranged along said lateral axis.

7. The detent device of claim 6, wherein said magnetic poles extend across only a portion of the width and length of at least one of said first and second faces.

8. The detent device of claim 1, further comprising a nonmagnetic area located between adjacent ones of at least one of of said at least one first and at least one second pairs of magnetic poles.

9. A switch for an automobile control panel having a circuit board, comprising:

a switching mechanism adapted to be mounted on the circuit board;

a first member adapted to be disposed over the circuit board, said first member including a first face having at least one first pair of magnetic poles creating a first magnetic field adjacent said first face;

a second member, including a second face having at least one second pair of magnetic poles creating a second magnetic field adjacent said second face, said second member movably associated with the first member such that said first magnetic field is in communication with said second magnetic field, and said at least one first pair and said at least one second pair of magnetic poles are structured and arranged to define at least three magnetic detent positions, each of said detent positions resisting movement of said second member relative to said first member, said magnetic fields of said first and second member providing a tactile detent feel and a position holding force; and a switch actuator coupled to said second member and said switching mechanism, said switch actuator being located outside of said first member, such that movement of said switch actuator moves said switching mechanism and moves said second member relative to said first member, said switch actuator adapted to extend from the control panel, through said first and second member to the circuit board.

10. The switch of claim 9, wherein said actuator is rotatable and is capable of rotating said second member relative to said first member.

11. The switch of claim 10, wherein said second member includes at least a portion of a disk defining said second face, said second pair of magnetic poles arranged along a diameter of said second face.

12. The switch of claim 11, further comprising a nonmagnetic area located between adjacent ones of said first and second poles.

13. The switch of claim 9, wherein said actuator is movable and moves said second member along a lateral axis of motion relative to said first member.

14. The switch of claim 9, wherein said at least one second pair of magnetic poles are arranged along a lateral axis of motion of said second member relative to said first member.

15. A user interface for a switch having a switch mechanism and a switch actuator, comprising:

a first member adapted to be disposed with the switch mechanism; and a second member adapted to be operably associated with the switch actuator and movably disposed relative to said first member, said second member including a face and at least one pair of magnetic poles creating a magnetic field extending adjacent said face, said second member having an extension removed from said at least one pair of magnetic poles and adapted to be coupled to the switch actuator;

said first member including a portion capable of being attracted or repelled by said magnetic field;

said first and second members arranged such that said magnetic field passes through said portion of said first member as the switch actuator is moved, and said at least one pair of magnetic poles are structured and arranged to define at least three magnetic detent positions, each of said detent positions resisting movement of said second member relative to said first member, said magnetic fields of said first and second member providing a tactile detent feel and a position holding force.

16. The user interface of claim 15, further comprising a switch face plate disposed between said first member and said second member.

17. The user interface of claim 15, wherein said portion of said first member includes at least one pair of magnetic poles.

18. The user interface of claim 17, further comprising:

a slide actuator; and said magnetic poles of said first and second members are arranged along a lateral axis of motion of said first and second members.

19. The user interface of claim 15, further comprising nonmagnetic areas defined between each adjacent said pair of magnetic poles.

20. The user interface of claim 15, further comprising:

a rotary actuator; and at least one of said first and second members comprise at least a portion of a disk.

21. A detent device for a switch wherein the switch is mounted to a printed circuit and includes a switch actuator, comprising:

a first member adapted to be disposed over the switch; and a second member having an actuating portion extending beyond said first member and being adapted to be coupled to the switch actuator and having a main portion movably disposed with said first member such that said second member moves relative to said first member when the switch actuator is moved;

said first and second members having magnetic properties capable of creating a magnetic field between said first and second members, said field alternately attracting and repelling said first and second members as said second member is moved relative to said first member, said first and second members structured and arranged such that said magnetic properties define at least three magnetic detent positions, each of said detent positions resisting movement of said second member relative to said first member, said magnetic fields of said first and second member providing a tactile detent feel and a position holding force.

22. The detent device of claim 21, further comprising:

a first face of said first member, said first face having at least one pair of magnetic poles; and a second face of said second member, said second face having at least one pair of magnetic poles;

said first and second faces disposed such that said at least one pair of magnetic poles of said first face is in communication with said at least one pair of magnetic poles of said second face.

23. The detent device of claim 22, further comprising a nonmagnetic area located between adjacent said pairs of magnetic poles of at least one of said first face and said second face.

24. The detent device of claim 1, wherein said at least one first pair and said at least one second pair of magnetic poles each include at least three alternatingly polarized magnetic poles.

25. The detent device of claim 1, wherein at least one of said at least one first pair and said at least one second pair of magnetic poles includes at least four alternatingly polarized magnetic poles.

26. The switch of claim 9, wherein said at least one first pair and said at least one second pair of magnetic poles each include at least three alternatingly polarized magnetic poles.

27. The switch of claim 9, wherein at least one of said at least one first pair and said at least one second pair of magnetic poles includes at least four alternatingly polarized magnetic poles.

28. The user interface of claim 15, wherein said at least one pair of magnetic poles includes at least three alternatingly polarized magnetic poles.

29. The user interface of claim 15, wherein said at least one pair of magnetic poles includes at least four alternatingly polarized magnetic poles, poles includes at least four alternatingly polarized magnetic poles.

30. The detent device of claim 22, wherein said at least one first pair and said at least one second pair of magnetic poles each include at least three alternatingly polarized magnetic poles.

31. The detent device of claim 22, wherein at least one of said at least one first pair and said at least one second pair of magnetic poles includes at least four alternatingly polarized magnetic poles.

* * * * *